US006173813B1

(12) United States Patent
Rebillard et al.

(10) Patent No.: US 6,173,813 B1
(45) Date of Patent: Jan. 16, 2001

(54) ELECTRONIC CONTROL FOR AN ELEVATOR BRAKING SYSTEM

(75) Inventors: Pascal Rebillard; Vincent Raillard; Gérard Sirigu, all of Gien (FR)

(73) Assignee: Otis Elevator Company, Farmington, CT (US)

( * ) Notice: Under 35 U.S.C. 154(b), the term of this patent shall be extended for 0 days.

(21) Appl. No.: 09/219,957

(22) Filed: Dec. 23, 1998

(51) Int. Cl.[7] ..... B66B 1/32
(52) U.S. Cl. ..... 187/287; 187/288
(58) Field of Search ..... 187/391, 287, 187/393, 289, 293, 288

(56) References Cited

U.S. PATENT DOCUMENTS

| | | | | |
|---|---|---|---|---|
| 3,584,706 | * | 6/1971 | Hall et al. | 187/29 |
| 4,457,404 | | 7/1984 | Husson et al. | 187/29 R |
| 4,538,706 | | 9/1985 | Koppensteiner . | |
| 4,662,481 | | 5/1987 | Morris et al. | 187/77 |
| 5,052,523 | | 10/1991 | Ericson | 187/89 |
| 5,065,845 | | 11/1991 | Pearson . | |
| 5,323,877 | | 6/1994 | Mori | 187/91 |
| 5,363,942 | * | 11/1994 | Osada | 187/376 |
| 5,377,786 | | 1/1995 | Nakagawa | 187/276 |
| 5,487,450 | | 1/1996 | Gerber | 187/367 |
| 5,648,644 | | 7/1997 | Nagel . | |
| 5,648,645 | | 7/1997 | Arpagaus et al. . | |

FOREIGN PATENT DOCUMENTS

| | | |
|---|---|---|
| 3934492 | 4/1990 | (DE) . |
| 0712804 | 5/1996 | (EP) . |
| 0543154 | 9/1997 | (EP) . |
| 0812796 | 12/1997 | (EP) . |
| 0856485 | 1/1998 | (EP) . |
| 0841282 | 5/1998 | (EP) . |
| 0662445 | 4/1999 | (EP) . |
| 3124688 | 5/1991 | (JP) . |
| 04066491 | 3/1992 | (JP) . |
| 4246079 | 9/1992 | (JP) . |
| 4-365771 | 12/1992 | (JP) . |
| 5-147852 | 6/1993 | (JP) . |
| 5-262472 | 10/1993 | (JP) . |
| 6255949 | 9/1994 | (JP) . |
| 07002452 | 1/1995 | (JP) . |
| 8198543 | 8/1996 | (JP) . |
| 9040317 | 2/1997 | (JP) . |
| WO 98/42610 | 10/1998 | (WO) . |

* cited by examiner

*Primary Examiner*—Jonathan Salata

(57) ABSTRACT

An exemplary embodiment of the invention is directed to an elevator braking system including an accelerometer for detecting acceleration of an elevator car and generating an acceleration signal. An over-acceleration detection module compares the acceleration signal to an acceleration threshold. If over-acceleration detection module detects an over-acceleration condition, a first switching device disrupts power to a solenoid in order to activate a braking assembly.

5 Claims, 5 Drawing Sheets

FIG.1
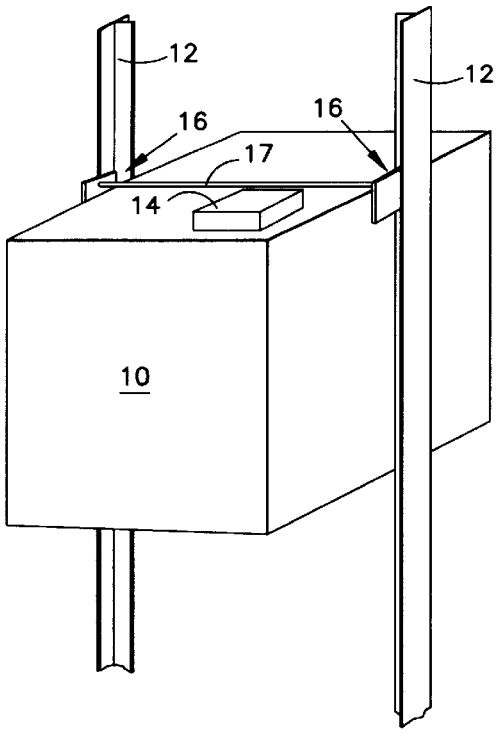
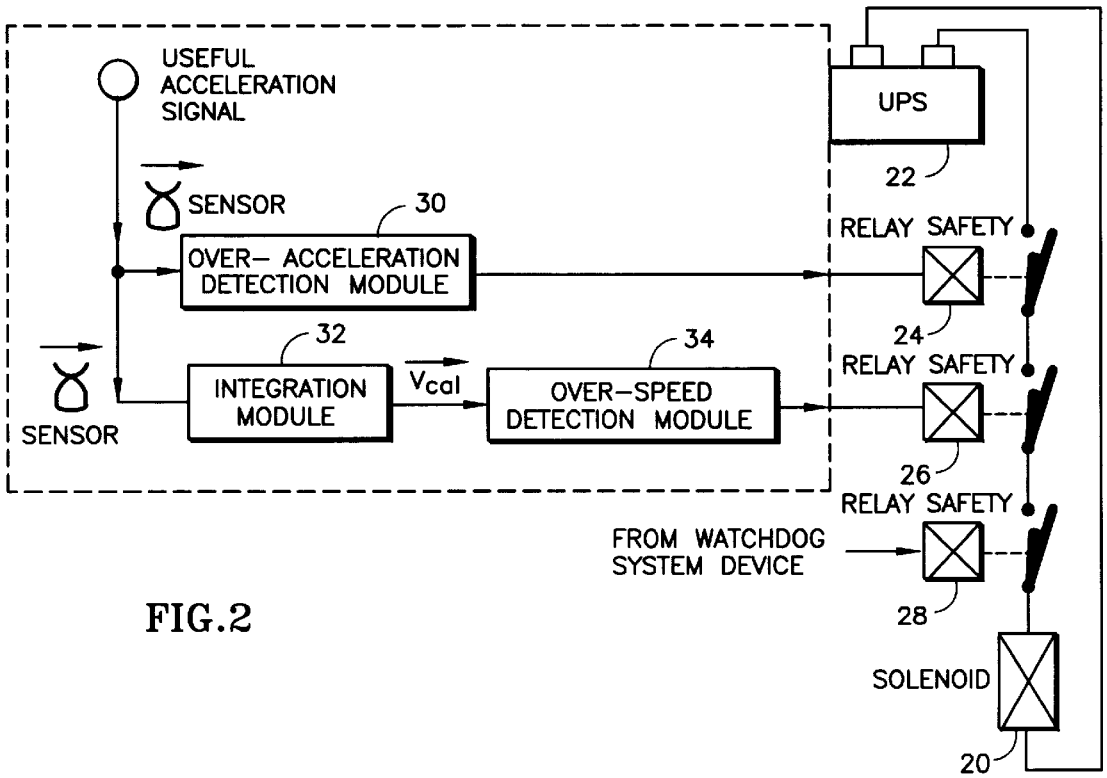
FIG.2

ELECTRONIC CONTROL FOR AN ELEVATOR BRAKING SYSTEM

FIELD OF THE INVENTION

The invention relates generally to an elevator safety system and in particular to an elevator safety system including an accelerometer for sensing elevator over-acceleration and over-speed conditions.

PRIOR ART

Elevators are presently provided with a plurality of braking devices which are designed for use in normal operation of the elevator, such as holding the elevator car in place where it stops at a landing and which are designed for use in emergency situations such as arresting the motion of a free-falling elevator car.

One such braking device is provided to slow an over-speeding elevator car which is travelling over a predetermined rate. Such braking devices typically employ a governor device which triggers the operation of safeties. In such elevator systems a governor rope is provided which is looped over a governor sheave at the top of the hoistway and a tension sheave at the bottom of the hoistway and is also attached to the elevator car. When the governor rope exceeds the predetermined rate of the elevator car, the governor grabs the governor rope, pulling two rods connected to the car. The rods pull two wedge shaped safeties which pinch a guide rail on which the elevator car rides thereby braking and slowing the elevator car.

Triggering safeties using a conventional, centrifugal governor has drawbacks. The governor rope often moves and occasionally such movements can have an amplitude strong enough to disengage the governor rope from its pulley and trigger the safety. In addition, the response time of a governor triggered safety is dependent upon the constant time of the rotating masses of the governor, the sheaves and the governor rope length. This leads to a delay in actuating the safeties and an increase in the kinetic energy of the elevator car that must be absorbed by the safeties. Lastly, the conventional governor triggered safeties require numerous mechanical components which requires significant maintenance to ensure proper operation.

BRIEF SUMMARY OF THE INVENTION

An exemplary embodiment of the invention is directed to a controller for use in an elevator braking system. The controller includes an accelerometer for detecting acceleration of an elevator car and generating an acceleration signal. An over-acceleration detection module compares the acceleration signal to an acceleration threshold. If the over-acceleration detection module detects an over-acceleration condition, a first switching device disrupts power to a solenoid in order to activate a braking assembly.

The braking assembly includes a brake linkage positionable in a first position and a second position. A spring biases the brake linkage towards the second position. A solenoid exerts magnetic force on a portion of said brake linkage counteracting said spring and maintaining said brake linkage in said first position. If power to the solenoid is interrupted by the controller or a power outage, the solenoid releases the brake linkage to brake the elevator.

The elevator braking system of the present invention provides benefits over conventional systems. The use of an electronic controller to detect over-acceleration and over-speed conditions results in more rapid deployment of the braking assembly thus reducing the amount of kinetic energy to be absorbed by the braking assembly. The braking assembly incorporates a fail safe design so that if power in the system is interrupted for any reason, the braking assembly is actuated to stop descent of the elevator car.

BRIEF DESCRIPTION OF THE DRAWINGS

Referring now to the drawings wherein like elements are numbered alike in the several Figures:

FIG. 1 is a perspective view of an elevator car including an electronic safety braking system;

FIG. 2 is a circuit diagram of a portion of a controller;

DETAILED DESCRIPTION OF PREFERRED EMBODIMENTS

Figure 3:
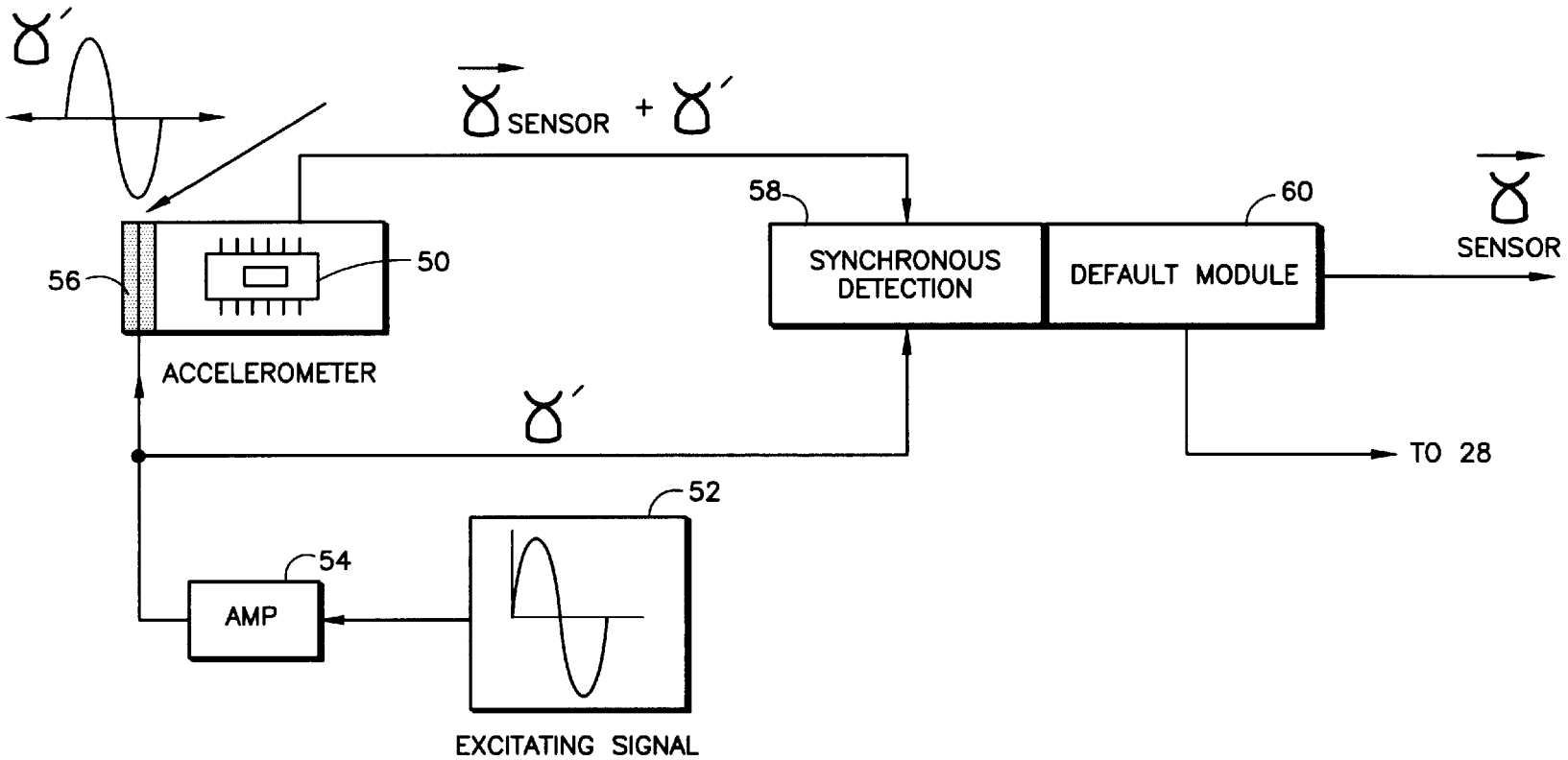
FIG. 3 is a circuit diagram of another portion of the controller.

FIG. 1 is a perspective view of an elevator car 10 including an electronic braking system in accordance with the present invention. The car 10 travels on rails 12 as is known in the art. Mounted on car 10 is a controller 14 which detects over-acceleration and over-speed conditions and actuates braking assemblies 16. FIG. 2 is a circuit diagram of a portion of the controller 14 which generates an output signal in the form of power to a solenoid 20 shown in both FIGS. 2 and 4. Solenoid 20 is in the braking assembly 16 as described below with reference to FIGS. 4 and 5. Solenoid 20 is powered by an uninterruptible power supply 22 through three safety relays 24, 26, and 28. Safety relays 24, 26, and 28 are normally open so that in the event of power failure, the safety relays 24, 26, and 28 will open disrupting power to the solenoid 20 and activating the braking assemblies 16. If any one of the safety relays 24, 26, or 28 is activated (e.g., opened), the current path to the solenoid 20 is broken. As described below with reference to FIGS. 4 and 5, disconnecting power from solenoid 20 activates the braking assemblies 16. The conditions for activating the safety relays 24, 26, and 28 will now be discussed.

A sensed acceleration signal $\vec{\gamma}_{sensor}$ is provided by an accelerometer 50 (FIG. 3) and provided to an over-acceleration detection module 30. The sensed acceleration signal is based on $$\vec{\gamma}_{sensor}(t)=\vec{\gamma}_{car}(t)+\vec{\gamma}_{error}(t) \tag{1}$$

where $\vec{\gamma}_{car}$ is the acceleration of the elevator car and $\vec{\gamma}_{error}$ is a sum of all the accelerometer errors (e.g. resolution error, sensitivity error, and linear error). The sensed acceleration signal is provided to the over-acceleration detection module 30 where the absolute value of the sensed acceleration is compared to an acceleration threshold. If the absolute value of the sensed acceleration exceeds the acceleration threshold, over-acceleration detection module 30 generates an over-acceleration signal which causes safety relay 24 to open and interrupt power to the solenoid 20 and activate the braking assemblies 16.

The sensed acceleration signal $\vec{\gamma}_{sensor}$ is provided to an integration module 32 which derives a calculated velocity signal as shown below:

$$\vec{V}_{cal}(t)=\int \vec{\gamma}_{sensor}(t)\cdot dt \quad (2)$$

Substituting equation 1 into equation 2 yields $$\vec{V}_{cal}(t)=\vec{V}_{car}(t)+\int \vec{\gamma}_{error}(t)\cdot dt$$

where $\vec{V}_{car}(t)=\int \vec{\gamma}_{car}(t)\cdot dt$ and $\int \vec{\gamma}_{error}(t)\cdot dt$ represent the integral of the accelerometer error signal.

The integration module 32 is designed to minimize the error term by using, for example, an operational amplifier integrator with a constant time such that:

$$\lim_{t\to\infty}\left(\int_0^{t\to} \gamma_{error}(t)\cdot dt\right)\to 0$$

The integration module 32 provides the calculated car velocity to an over-speed detection module 34. The over-speed detection module 34 compares the absolute value of the calculated car velocity to a velocity threshold. If the absolute value of the calculated car velocity exceeds the velocity threshold, over-speed detection module 34 generates an over-speed signal which causes safety relay 26 to open and interrupt power to the solenoid 20 and activate the braking assemblies 16. The over-acceleration detection module 30 and over-speed detection module 34 are designed so as to not activate the braking assemblies when a passenger jumps in the car.

FIG. 3 is a schematic diagram of another portion of the controller 14. Accelerometer 50 generates the sensed acceleration signal $\vec{\gamma}_{sensor}$ as described above. Accelerometer 50 may be a commercially available accelerometer such as a EuroSensor model 3021, a Sagem ASMI C30-HI or Analog Devices ADXL50. To insure operation of the system, the circuit of FIG. 3 includes circuitry for constantly determining whether the signal produced by the accelerometer 50 is accurate. To constantly test the accelerometer, a sinusoidal signal generator 52 produces a sinusoidal signal shown as $\gamma'$ which is amplified by amplifier 54 and provided to a piezoelectric excitator 56. The accelerator 50 vibrates due to the vibration of the piezoelectric excitator 56. Thus, the output of the accelerometer 50 is a combination of the sensed acceleration $\vec{\gamma}_{sensor}$ and the piezoelectric vibration $\gamma'$. The output of the accelerometer 50 and the output of amplifier 54 are provided to a synchronous detector 58. The synchronous detector separates the accelerometer $\vec{\gamma}_{sensor}$ and the accelerometer signal due to piezoelectric vibrations $\gamma'$. The default module 60 detects the presence of the sinusoidal signal $\gamma'$ in the accelerometer output. If the sinusoidal signal $\gamma'$ is not present in the accelerometer output signal, then some part of the circuit (e.g. accelerometer 50) is not functioning properly and an activation signal is sent to safety relay 28 in FIG. 2. Activating safety relay 28 disrupts power to the solenoid 20 to activate braking assembly 16. The sensed accelerometer signal $\vec{\gamma}_{sensor}$ is provided to over-acceleration detection module 30 and integration module 32 as described above with reference to FIG. 2.

Figure 4:
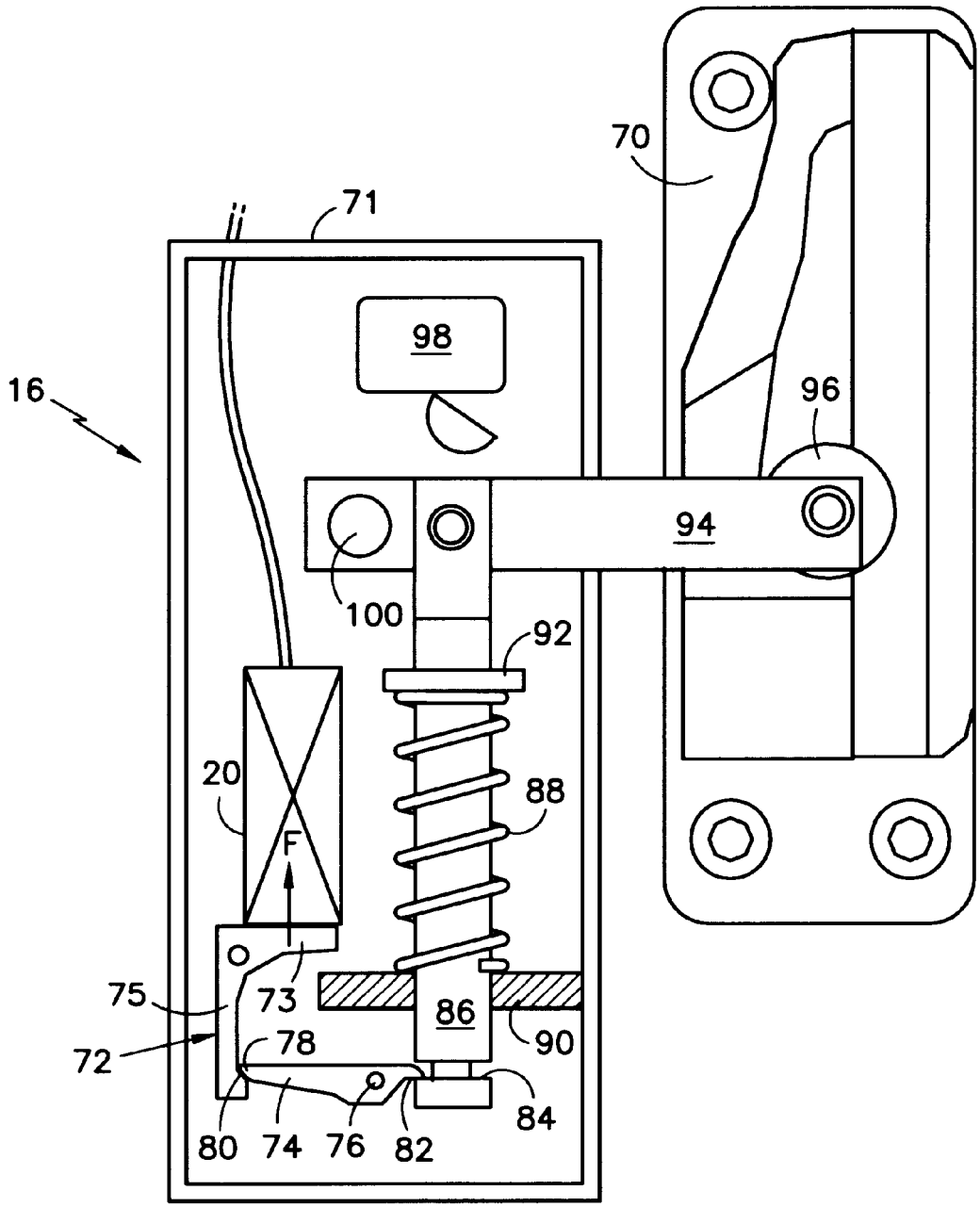
FIG. 4 is a side view of a braking assembly in a deactivated state.

FIG. 4 is a side view of a braking assembly 16. The brake assembly includes an actuator 71 and a brake block 70. Brake block 70 may be similar to the safety brake disclosed in U.S. Pat. No. 4,538,706, the contents of which are incorporated herein by reference. The actuator 71 includes solenoid 20 (as shown in FIG. 2) which, when powered, applies magnetic force F on a pivotal, L-shaped trigger 72. Trigger 72 includes a first arm 73 upon which the solenoid applies magnetic force and a second arm 75 substantially perpendicular to first arm 73. The force from solenoid 20 rotates the trigger 72 counter-clockwise and forces the trigger against a dog 74. Dog 74 is pivotally mounted on a pin 76 and has a first end 78 contacting a lip 80 on trigger 72 and a second end 82 engaging a lip 84 on rod 86. Rod 86 is biased upwards by a spring 88 compressed between a mounting plate 90 and a shoulder 92 on rod 86. A distal end of rod 86 is rotatably connected to a disengaging lever 94. An end of the disengaging lever 94 is positioned within a conventional brake block 70 and includes a jamming roller 96. The other end of disengaging lever 94 is pivotally connected at pin 100. The trigger 72, dog 74, rod 86 and disengaging lever 94 form a brake linkage for moving the jamming roller 96. It is understood that other mechanical interconnections may be used to form the brake linkage and the invention is not limited to the exemplary embodiment in FIG. 4.

A bar 17 (shown in FIG. 1) may be connected to the brake linkage (e.g. at disengaging lever 94) to move another jamming roller in another brake block 70 upon disrupting power to solenoid 20. Accordingly, only one actuator is needed for two brake blocks 70. Positioned above the rod 86 is a switch 98 which can disrupt power to the elevator hoist. In the condition shown in FIG. 4, the hoist is powered. The solenoid 20 is also receiving power thereby maintaining spring 88 in a compressed state through trigger 72, dog 74 and rod 86.

Figure 5:
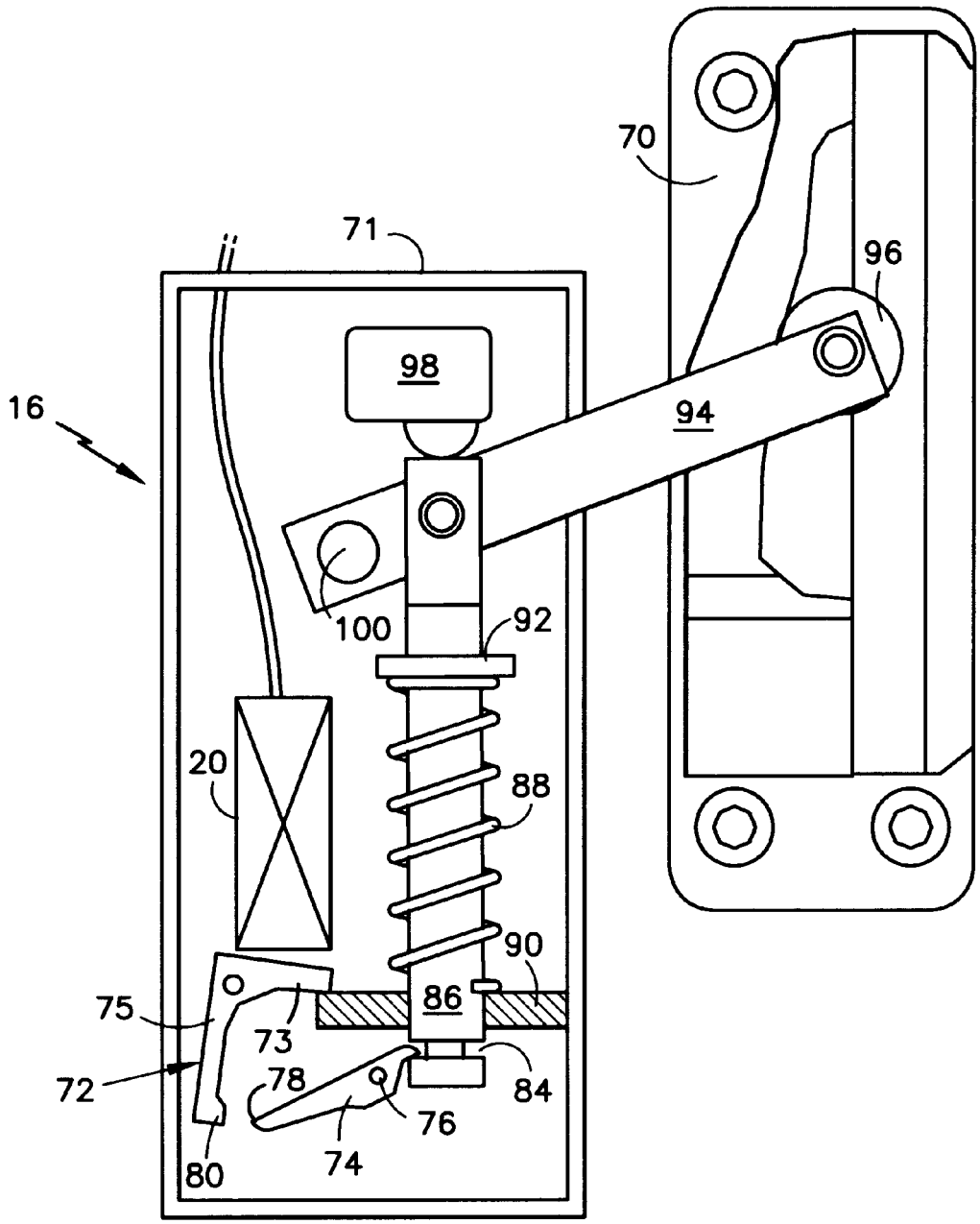
FIG. 5 is a side view of the braking assembly in an activated state.

FIG. 5 shows the condition of the brake assembly upon detection of an over-speed condition, an over-acceleration condition or a defect in the controller. As described above, any of these conditions activates one of solenoids 24, 26 or 28 and disrupts power to solenoid 20. This allows trigger 72 to rotate freely and releases the dog 74. Once dog 74 is released from trigger 72, rod 86 is driven upwards by compressed spring 88. Disengage lever 94 is rotated counterclockwise forcing jamming roller 96 upwards into brake block 70 wedging the roller 96 against rail 12 and stopping movement of elevator car 10. At the same time, switch 98 is contacted by the end of rod 86 so as to disrupt power to the elevator hoist. Once the defect that caused the braking assembly to activate is repaired, a technician can manually reset the braking assembly 16 by compressing spring 88 and restoring the braking assembly 16 to the state shown in FIG. 4.

Figure 6:
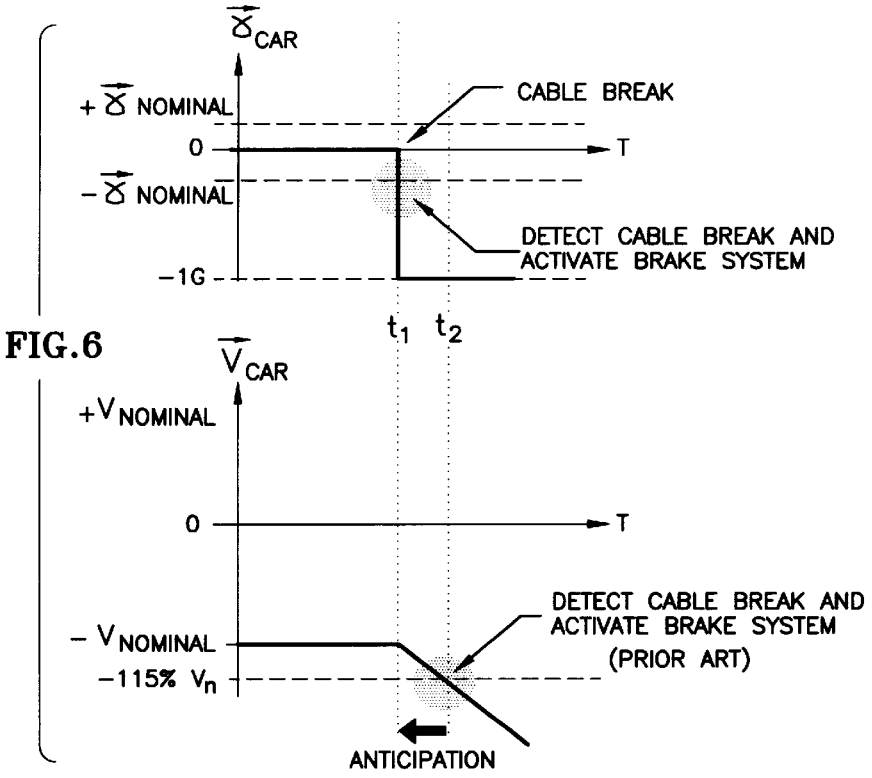
FIG. 6 depicts graphs of acceleration versus time and velocity versus time when an elevator cable breaks during downward travel.

As described above, the invention activates the braking assembly upon detection of one of an over-acceleration event, an over-speed event or a failure in the controller circuitry. Operation of the braking system when the elevator cable breaks (i.e. an over-acceleration event) will now be described with reference to FIGS. 6 and 7. FIG. 6 depicts graphs of the elevator car acceleration and velocity versus time when the car is traveling downward. The elevator car is traveling downward at a constant speed of $V_{nominal}$ and with an acceleration of 0. At time $t_1$ the elevator car cable breaks causing the acceleration to immediately become—1G. This causes the absolute value of the car acceleration to exceed $\gamma_{nominal}$ and the over-acceleration detection module 30 sends a signal to safety relay 24 to disrupt power to solenoid 20. As described above, this activates the braking assembly 16 to prevent the elevator car 10 from further descent. The velocity of the car upon activation of the brake system is approximately $V_{nominal}$ in the downward direction. Because the elevator car is traveling downward, the brake block 70 engages rail 12 almost instantaneously.

FIG. 6 also depicts activation of the brake system as performed by the prior art system. As shown in the plot of car velocity $V_{car}$ versus time, the conventional emergency braking system would not detect the cable breakage until the car velocity exceeded a threshold of 115% of the nominal velocity. As shown in FIG. 6, the conventional system would not detect the cable break and activate the emergency brake until time $t_2$. Thus, the invention provides an earlier or anticipated activation of the emergency brake. Earlier activation of the emergency brake reduces the amount of kinetic energy that must be absorbed to stop the elevator car.

Figure 7:
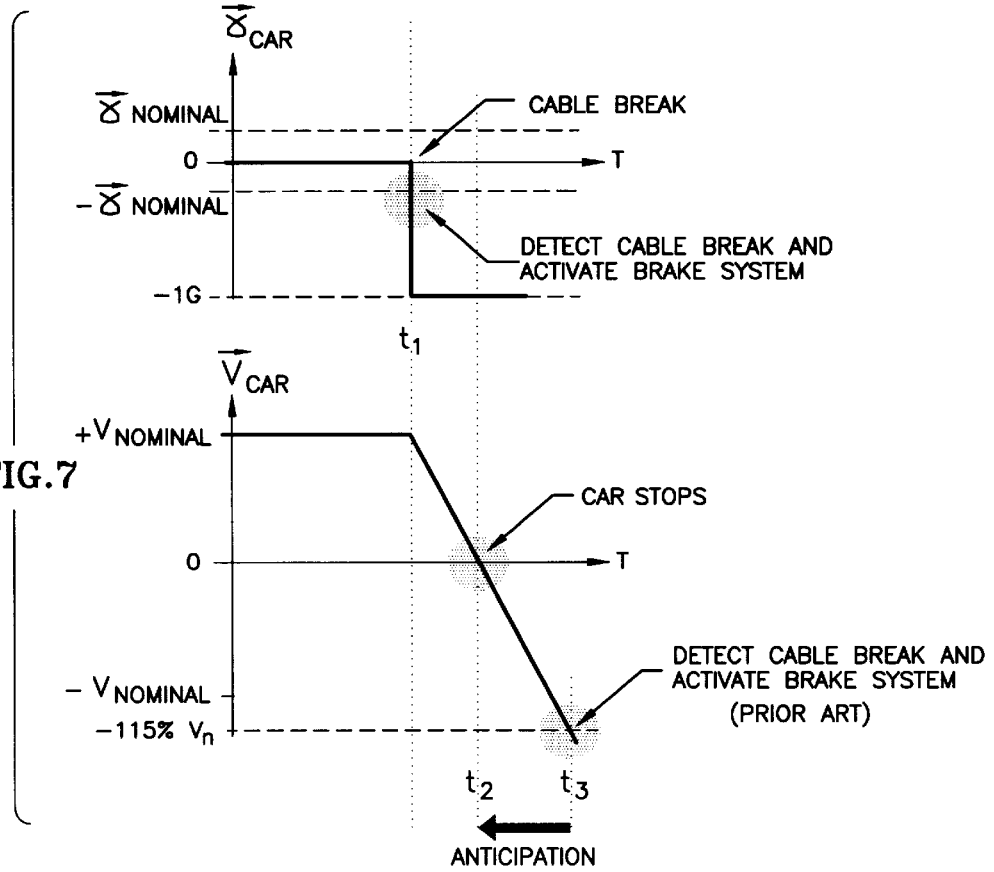
FIG. 7 depicts graphs of acceleration versus time and velocity versus time when an elevator cable breaks during upward travel.

FIG. 7 depicts graphs of the elevator car acceleration and velocity versus time when the car is traveling upwards. The elevator car is traveling upwards at a constant speed of $V_{nominal}$ and with an acceleration of 0. At time $t_1$ the elevator car cable breaks causing the acceleration to immediately become —1G. This causes the absolute value of the car acceleration to exceed $\gamma_{nominal}$ and the over-acceleration detection module 30 sends a signal to safety relay 24 to disrupt power to solenoid 20. As described above, this activates the braking assemblies 16 to prevent the elevator car 10 from descending. When the car is traveling upwards, activation of the braking assemblies does not immediately stop motion of the car. The brake block 70 is designed to restrict motion in the downward direction as is known in the art. Thus, the car will continue traveling upward due to its inertia until the car is speed is zero or slightly negative (downward). At this point, the brake block 70 engages rail 12 to prevent descent of the elevator car. Thus, the car is allowed to decelerate to a speed of approximately zero at which time the brake block 70 engages rail 12.

The plot of velocity $V_{car}$ versus time in FIG. 7 indicates that the car stops at time $t_2$ with a velocity of approximately 0 with the present invention. FIG. 7 also depicts activation of the brake system as performed by the prior art system. As shown in the plot of car velocity $V_{car}$ versus time, the conventional emergency braking system would not detect the cable breakage until the car velocity exceeded a threshold of 115% of the nominal velocity. As shown in FIG. 7, the conventional system would not detect the cable break and activate the emergency brake until time $t_3$. Thus, the invention provides an earlier or anticipated activation of the emergency brake. Earlier activation of the emergency brake reduces the deceleration experienced by passengers in the elevator car.

The braking system of the present invention provides earlier activation of the emergency braking system as compared to the conventional braking system. This reduces the amount of deceleration that the passengers must endure in an emergency braking situation. The invention provides an elevator safety system that is reliable and easily assembled. The over-acceleration and over-speed conditions can be adjusted electronically which makes the system applicable to a variety of cars.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A controller providing an output signal to a braking assembly in an elevator braking system, the controller comprising:

an accelerometer detecting acceleration of an elevator car and generating an acceleration signal;

an over-acceleration detection module comparing the acceleration signal to an acceleration threshold and generating an over-acceleration signal;

a first switching device interrupting said output signal in response to said over-acceleration signal;

an integration module for receiving said acceleration signal and generating a velocity signal;

an over-speed detection module for comparing the velocity signal a velocity threshold and generating an over-speed signal; and a second switching device for interrupting said output signal in response to said over-speed signal.

2. A controller providing an output signal to a braking assembly in an elevator braking system, the controller comprising:

an accelerometer detecting acceleration of an elevator car and generating an acceleration signal;

an over-acceleration detection module comparing the acceleration signal to an acceleration threshold and generating an over-acceleration signal;

a first switching device interrupting said output signal in response to said over-acceleration signal;

a signal generator generating a sinusoidal signal;

a piezoelectric excitator receiving said sinusoidal signal and imparting vibration on said accelerometer;

a default module receiving an output signal from said accelerometer and generating a default signal in response to the presence of the sinusoidal signal; and a third switching device interrupting said output signal in response to said default signal.

3. The controller of claim 2 further comprising:

an amplifier receiving said sinusoidal signal, amplifying said sinusoidal signal and providing the amplified sinusoidal signal to said piezoelectric excitator.

4. The controller of claim 2 wherein said default module includes:

a synchronous detector separating the sinusoidal signal from the acceleration signal.

5. The controller of claim 1 wherein said output signal is a power signal.

* * * * *